US005497646A

United States Patent [19]

Roberts et al.

[11] Patent Number: 5,497,646

[45] Date of Patent: Mar. 12, 1996

[54] AIR STRIPPER FOR CAN BODY MAKER APPARATUS

[75] Inventors: Stephen C. Roberts, Palmer Lake; Frank L. O'Brien, Westminster, both of Colo.

[73] Assignee: Aluminum Company of America, Pittsburgh, Pa.

[21] Appl. No.: 435,346

[22] Filed: Jan. 5, 1995

[51] Int. Cl.[6] ..... B21D 22/00; B21D 45/00; B21D 22/21; B21D 45/08

[52] U.S. Cl. ..... 72/345; 72/347; 72/427

[58] Field of Search ..... 72/344, 345, 347, 72/349, 427, 464

[56] References Cited

U.S. PATENT DOCUMENTS 3,696,659 10/1972 Lawford ..... 73/4 R
4,934,169 6/1990 Sjögren ..... 72/385

*Primary Examiner*—Lowell A. Larson
*Assistant Examiner*—Rodney A. Butler
*Attorney, Agent, or Firm*—Thomas R. Trempus

[57] ABSTRACT

In a can body maker apparatus including ram means for the forming of a can body mounted for reciprocal motion within a can body maker frame, an improved pressurized air delivery system is incorporated into the ram system to accomplish the air strip of the formed can body.

26 Claims, 4 Drawing Sheets

AIR STRIPPER FOR CAN BODY MAKER APPARATUS

FIELD OF THE INVENTION

This invention relates generally to can body makers and more particularly to the air stripper that cooperates with the ram of the can body maker to fill a formed can body with pressurized air to separate the can body from the ram upon completion of the can body drawing and ironing process.

BACKGROUND OF THE INVENTION

A conventional can body maker apparatus is disclosed in U.S. Pat. No. 3,696,659, issued to J. H. Maytag and an improvement to the ram assembly of the can body maker ram assembly is disclosed in U.S. Pat. No. 4,934,169, issued to C. M. Grimes, et al. Both of these patents are assigned to Adolph Coors Company. The aforedescribed patents are incorporated herein by reference as if fully set forth.

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates sufficient to form between about 180 and 220 can bodies per minute. The ram can be supported for straight line, or X-axis, motion by a mounting structure that incorporates fluid bearing technology. The stroke length, that is the distance traveled by the movable ram, is between about 18 to 26 inches.

In conjunction with the reciprocal motion of the ram, a redraw sleeve is supported in a redraw assembly. The redraw sleeve engages the shell prior to contact by the ram, applying a restraining force against the shell as the ram works the shell through a redraw die. The redraw process elongates the side walls of the can shell and decreases the side wall thickness and overall diameter of the can shell. The redraw operation is followed by two or three ironing stations that further elongate and thin the walls of the can shell to form a one piece can body. Finally, the body maker can be equipped with a doming station that further forms the enclosed bottom of the can body into a desired structural configuration and a stripper that performs the final operation on the can body. On the forward stroke of the ram, the redraw sleeve clamps the metal against a domer pressure ring to form the chime. As the ram makes contact with the domer die of the domer station, an air strip fills the ram and the can with pressurized air. When the ram begins its return cycle, the can is separated from the ram. It is the present practice to supply air to the air strip by a flexible hose directly attached to the ram and to switch the air on and off by a conventional valve.

SUMMARY OF THE INVENTION

In a can body maker apparatus including ram means for the forming of a can body mounted for reciprocal motion within a can body maker frame, an improved pressurized air delivery system is incorporated into the ram system to accomplish the air strip of the formed can body from the ram.

The can body maker apparatus includes a can body maker frame and a ram means for forming the can body mounted for reciprocal motion within the can body maker frame. The ram means includes an exterior surface and a generally, axially disposed passage extending from a first location proximate a first end, i.e., the metal working end, of the ram means to a second location distal the first end. The second location has means defining at least one passage radiating outwardly from the axially disposed passage to the ram means' exterior surface. Preferably, four such passages are arranged at 90 degree increments, extending from the axially disposed passage through the exterior of the ram means. The pressurized air delivery system includes an air delivery housing defining therein a bore adapted to receive therein the ram means. The housing defines a cavity that is in fluid communication with the bore. During a first predetermined portion of the reciprocal motion of the ram means, at least one passage radiating outwardly to the exterior surface of the ram means is in fluid communication with the air delivery housing bore to permit fluid flow thereinbetween. During a second predetermined portion of the reciprocal motion of the ram means, the surface of the ram means inhibits fluid flow from the air delivery housing to the axially disposed passage of the ram means. The reciprocating motion of the ram means serves to "turn on and turn off" the pressurized air flow from the housing to the air stripper at the metal working end of the ram means.

It is an object of this invention to provide an improved air stripper for use in can body makers.

It is also an object of this invention to provide a pressurized air delivery system that cooperates with the ram to provide pressurized air to the stripper in the can body maker.

It is a further object of this invention to replace the separately activated valve function currently employed in can body makers with an automatic switching function controlled by the position of the ram relative to a pressurized air delivery housing through which the ram travels.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
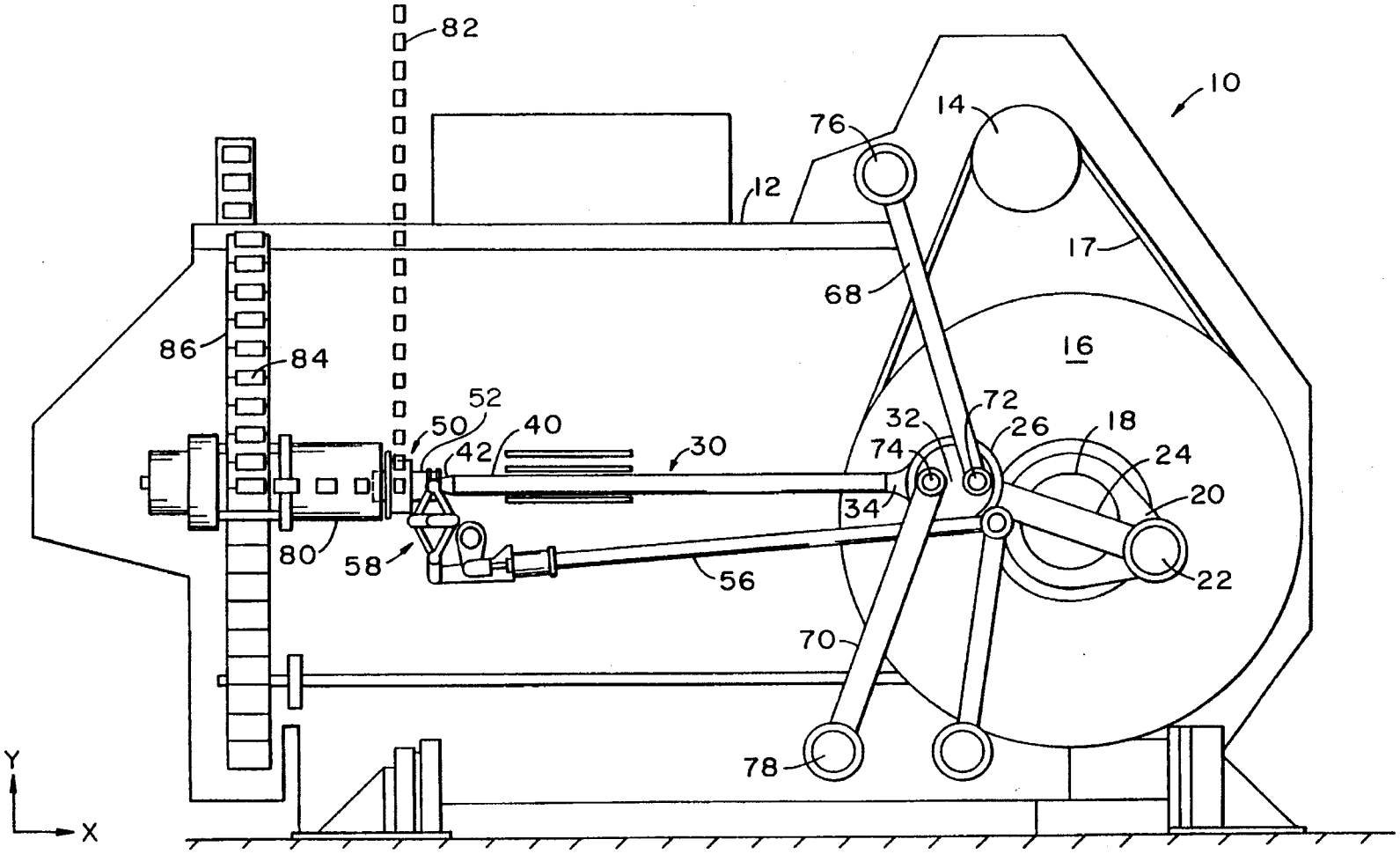
FIG. 1 (PRIOR ART)
FIG. 1 is a somewhat diagrammatic view of a prior art can body maker apparatus.

In order to fully appreciate the various aspects of this invention, it is useful to understand certain fundamental features of a typical can body maker apparatus. Turning now to FIG. 1, a can body maker illustrating a prior art ram main drive system is generally indicated by the reference character 10. The can body maker 10 includes a frame or housing structure 12 having mounted thereon a motor 14 that drives a large pulley wheel 16 by belt 17. The pulley wheel 16 is fixedly mounted on one of a pair of transversely extending axially aligned crankshafts 18 with crank arms 20. The crankshafts 18 are rotatable in bearings mounted in opposed sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the ram or straight line motion assembly generally designated by the reference character 30. The pivotal point of the assembly is designated 32. The cross head member 26 is engaged circumferentially by the end of a carriage connecting rod 34 by the connecting rod 24. The carriage connecting rod 34 is pivotably connected at its other end to a ram assembly 40, in which is mounted a ram or punch generally indicated at 42. The ram is supported for reciprocal movement in a fluid bearing or the like as is taught in U.S. Pat. No. 4,934,169.

The ram or straight line motion assembly 30 includes a side thrust resisting, upper swing lever 68 and lower swing lever 70, both bifurcated at their inner ends so as to straddle the cross head member 26. The upper swing lever 68 is pivotably connected to the cross head member 26, as indicated at 72, and the lower swing lever 70 is pivotably connected at 74 to the cross head member 26. The upper end of the upper swing lever 68 is pivotably connected to the fixed pivots 76 on frame members 12, and the lower end of the lower swing lever 70 is pivotably connected to the fixed pivots 78 on frame members 12.

A redraw sleeve supporting assembly generally indicated at 50 is located adjacent a tool pack housing 80. A redraw sleeve 52 travels along an axis that is parallel to the ram 42 and movable in longitudinal or X axis motion independently of the ram. The tool pack housing 80, mounted in the front, or left hand portion of the can body maker as illustrated in FIG. 1, encloses a series of drawing and ironing dies (not shown) through which a work piece such as a shallow cup 82 is worked by the ram in combination with the redraw assembly 50. The cup 82 is drawn and ironed into a can body 84 and a suitable transport system 86 conveys the can body 84 from the body maker 10 for further processing. The redraw assembly 50 is located in front of the ram assembly 30 and next to the tool pack housing 80. The redraw assembly 50 performs the redraw operation and provides the alignment structure for the redraw sleeve 52. Generally, the redraw sleeve 52 aligns the metal cup 82 during the redraw operation and provides the correct pressure to the metal cup holding it against the redraw die face of the tool pack housing 80. The redraw sleeve is a component of the redraw assembly 50. The redraw sleeve is slideably mounted for reciprocal motion and is driven by means of a drive rod 56 and linkage 58. A redraw assembly and a drive mechanism are described in detail in assignee's co-pending U.S. patent application Ser. No. 171,232, "Improved Redraw Mechanism for Can Body Maker Apparatus"; and Ser. No. 174,232, "Improved Can Body Maker Apparatus with Flexible Redraw Sleeve".

Turning now to FIGS. 2 through 6, the improved pressurized air delivery housing and stripper apparatus according to this invention will be described. The pressurized air delivery housing 100 has a lower half 102 and an upper half 104. The lower half 102 includes mounting brackets 106 and 108 extending rearwardly therefrom. The lower half 102 and upper half 104 that form the housing 100 define a bore 110 (FIGS. 5 & 6) adapted to receive therein the ram member 42.

Figure 4:
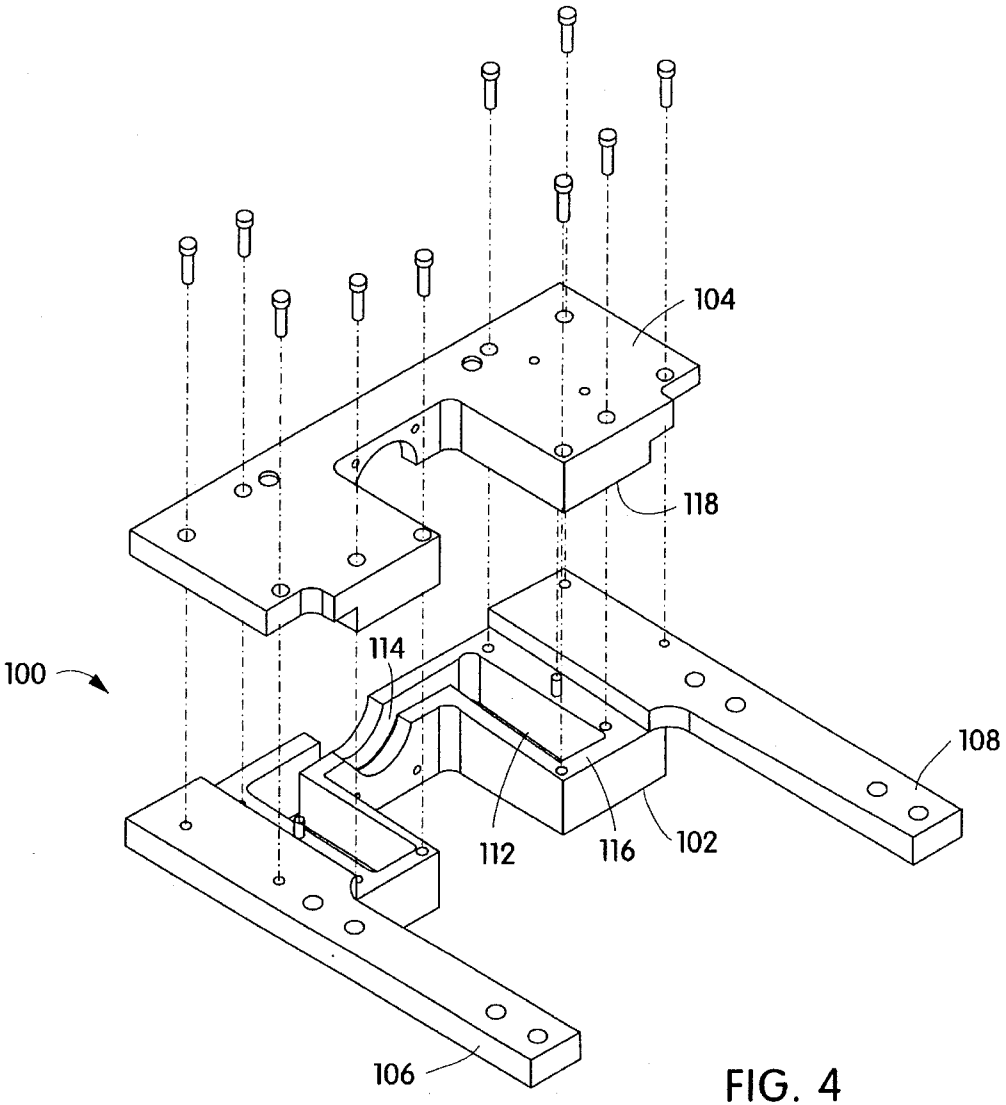
FIG. 4 is an exploded view of the upper and lower sections of the pressurized air delivery housing.
Figure 6:
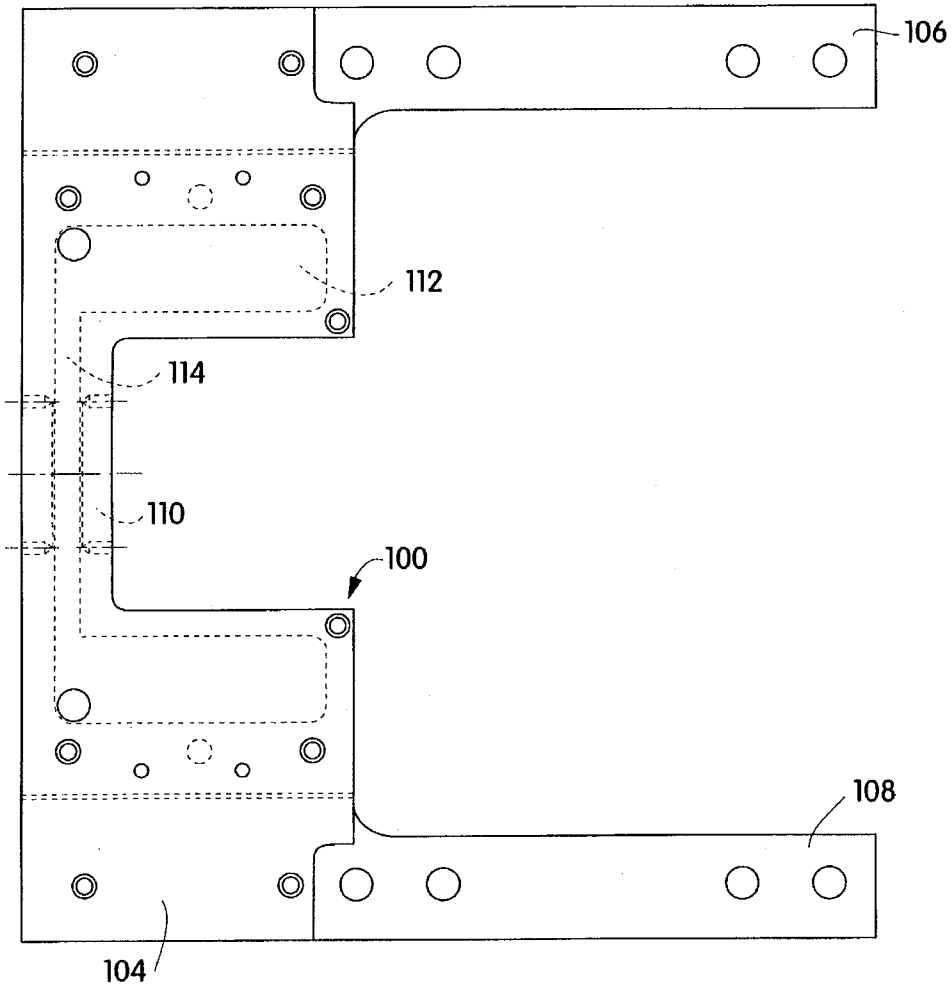
FIG. 6 is a top plan view of the pressurized air delivery housing with the interior air delivery chamber shown in phantom taken on Lines 6—6 of FIG. 5.

Within the housing 100 there is defined a chamber 112 (FIGS. 4 & 6). As can be seen in the exploded view of the housing in FIG. 4 and the top plan view of FIG. 6, the chamber 112 is defined in part by the lower half 102 of the housing and the upper half 104 of the housing. The chamber 112 is in communication with the bore 110 as at 114. It is to be appreciated that while not illustrated, the upper half 104 of the housing 100 can be provided with a chamber-like area similar to that chamber shown in the lower half 102 of the housing. When the upper housing 104 is mounted onto the lower housing half 102, there is defined there within an air strip pre-charge chamber (also indicated by the reference character 112). Appropriate gasket means can be provided at the mating surfaces 116 and 118 of the lower half and upper half of the housing. A valve means 120 can be mounted onto the upper surface 122 of the upper housing half 104. A pneumatic supply (not shown) is in fluid communication with the valve means 120. The optional valve means 120 permits the air flow to the housing to be secured for maintenance, inspection, etc.

Figure 3:
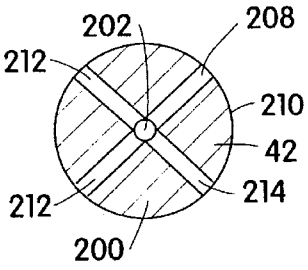
FIG. 3 is a cross sectional view of the ram along Lines 3—3 of FIG. 2.

A section through the ram means 42 is shown in FIG. 3. The ram means 42 has a body portion 200. A generally axially disposed bore 202 extends from a first location proximate the first end, or metal working end, 204 of the ram means to a second location 206 distal the first location 204. At the second location 206, means as at 208 define at least one passage radiating generally outwardly from the axially disposed central bore 202 to the exterior surface 210 of the ram 42. Preferably, four such radially extending passages as at 208, 212, 214 and 216 are provided in the ram 42. Preferably, the passages 208, 212, 214 and 216 are spaced at 90° intervals, however, various other combinations of either a fewer or greater number of passages can be provided.

Figure 2:
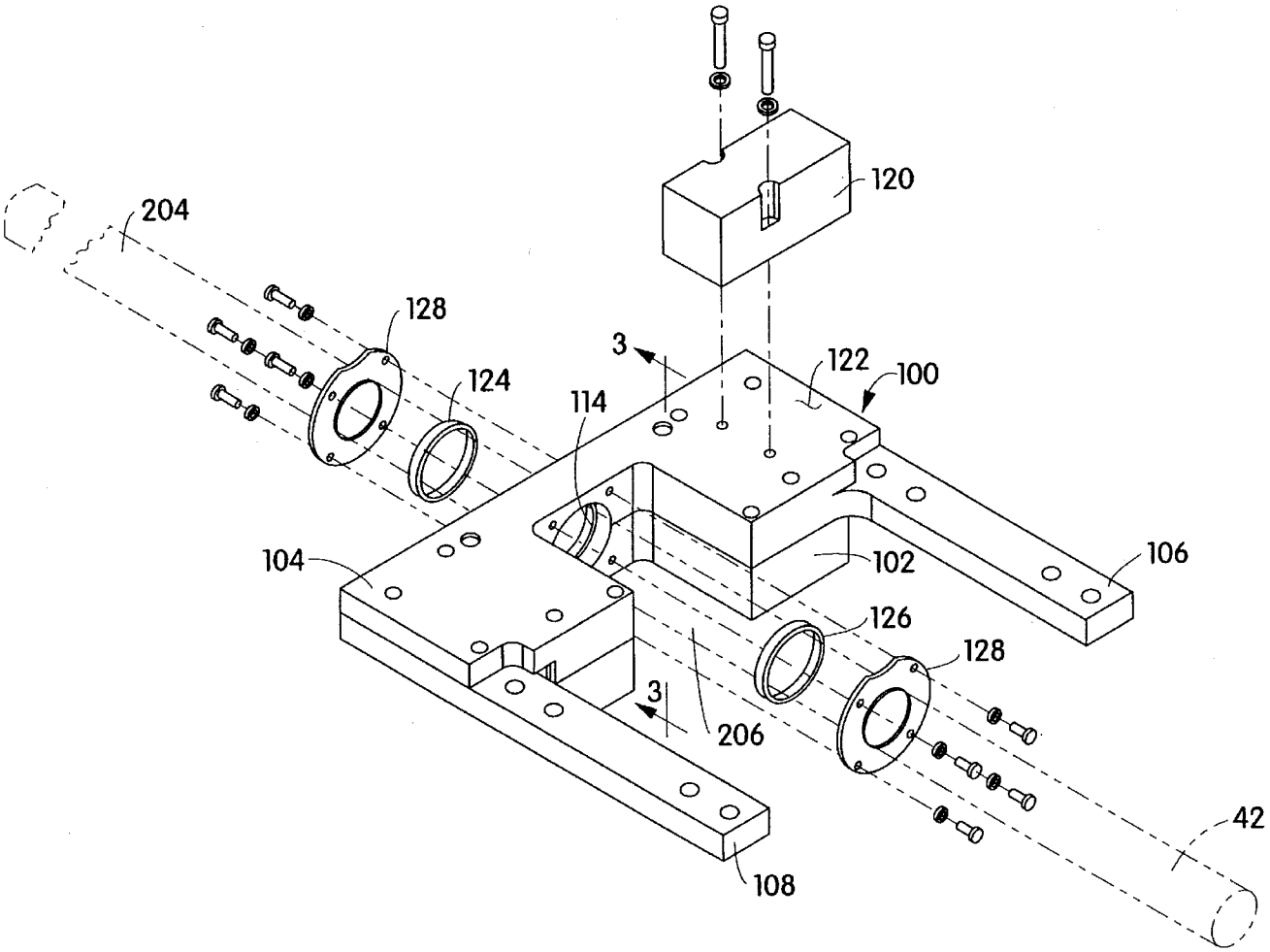
FIG. 2 is a partial exploded perspective view of the air delivery housing and a ram extending therethrough with portions of the ram cut away.
Figure 5:
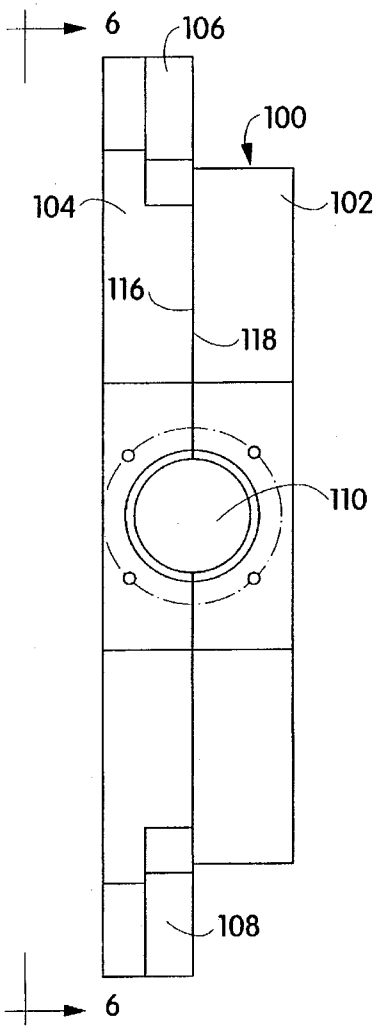
FIG. 5 is an elevational view of the rear face of the pressurized air delivery housing.

Turning to FIGS. 2, 5, and 6, the relationship of the ram 42 and the housing 100 can be more fully appreciated. The housing 100 includes forward seal member 124 and rearward seal member 126. The term "forward" describes the face of the housing 100 nearest the tool pack housing 80 (FIG. 1), while "rearward" refers to the face of the housing, opposite thereto. The seals 124 and 126 are mounted in the housing 100 and facilitate the reciprocal movement of the ram 42 through the bore 110. Care should be exercised in the installation of the seals 124 and 126 so as not to block the means 114 by which the chamber 112 is in fluid communication with the bore 110. Caps 128 can be removably attached to the forward portion and rearward portion of the housing 100 in order to retain the seals in place.

In operation, the housing 100 is secured by means of brackets 106 to the can body maker at a location disposed rearwardly of the redraw mechanism. Preferably, the housing is mounted to the rear of the fluid bearing structure, i.e., the forward face of the housing is proximate the rear of the fluid bearing. The rearward face of the housing is proximate the crank assembly. As the ram member 42 is reciprocated toward and away from the tool pack, the ram 42 slides through the bore 110 of the housing 100. In all positions of the ram except for one specific instance that will be described below, the exterior surface 210 of the ram 42 substantially maintains a seal within the bore 110 at the location 114 where the chamber is in communication with the bore 110. However, as the ram progresses through the housing such that the second location 206 of the ram 42 is disposed within the housing 100, fluid communication is established by means of the passage 208 (and 212, 214, and 216) with the axially disposed or central bore 202 of the ram. Once this fluid communication is established between the housing 100 and the central bore 202 of the ram 42, pressurized air is conveyed through the ram to effect the air stripping operation.

In a typical can body making operation, the stroke length of the crank is approximately 18.5 inches and the travel of the ram is approximately 18.5 inches. Pressurized air to effect the stripper operation is required for approximately 20° before and after top-dead-center of crank rotation or approximately 1.75 inches of the ram's total travel. In such a system, 20° of crank rotation is translated into 0.75 inch of ram travel.

It should be appreciated that the desired size of the can body being manufactured dictates the size of the ram employed in the body making operation. For illustrative purposes only, a ram having about a 2½ inch diameter would incorporate preferably four passages as at 208 that are approximately ⅜ inch in diameter. During operation, on the forward stroke as the ram moves forward to make contact with the domer dyes, the second location 206 of the ram 42 is positioned within the housing 100. The chamber 112 formed within the housing 100 is "precharged" by air pressure from a source of continuously pressurized air between about 30 to 60 psi. As the second location of the ram enters into the bore 112, fluid communication is immediately established between the passages 208 (and 212, 214, and 216) and the chamber 112. The pressurized air maintained in the reservoir like chamber 112 provides the air strip assist, filling the can disposed about the end of the ram with pressurized air. Because of the length of the ram bore, a drop of air pressure is experienced at the can body. Accordingly, it is preferred that the chamber 112 be maintained at the high end of the range, i.e., 60 psi. As the ram 42 begins its return cycle, drawing rearwardly away from the tool pack, the can body is blown off the head of the ram and urged against the domer. The formed can body is removed from the body maker by any of a number of techniques known in the art. (If the can body fails to come off the ram, the edge of the can contacts spring loaded stripper segments (not shown). These segments disengage the can from the ram.) As the ram 42 continues its rearward travel, the second location 206 exits the housing 100. As a result the exterior surface 210 of the ram 42 acts as a seal to "turn off" the pneumatic source to the air stripper of the ram 42. The air supply in the ram's central bore is vented to atmosphere. Through the use of the ram and housing configuration of this invention, the ram itself functions as a switch to "turn on" and "turn off" the source of pneumatic air for the stripper function, even though a continuous supply of pressurized air is maintained to the housing 100.

The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. An air strip system in a can body maker apparatus comprising: a can body maker frame, a ram means for the forming of a can body mounted for reciprocal motion within the can body maker frame, said ram means having an exterior surface and a generally, axially disposed passage extending from a first location proximate a first end of the ram means to a second location distal said first end, said second location having means defining at least one passage radiating outwardly from the axially disposed passage to the ram means exterior surface; an air delivery housing defining therein a bore adapted to receive therein the ram means, said housing further defining a cavity in fluid communication with said bore, wherein during a first predetermined portion of the reciprocal motion of the ram means, the at least one passage radiating outwardly to the exterior surface of the ram means is in fluid communication with the air delivery housing bore to permit fluid flow thereinbetween while during a second predetermined portion of the reciprocal motion of the ram means, the surface of the ram means inhibits fluid flow from the air delivery housing to the axially disposed passage of the ram means.

2. The combination according to claim 1 wherein the air delivery housing includes an upper half and a lower half.

3. The combination according to claim 1 wherein the air delivery housing includes mounting means adapted to support the air delivery housing in the can body maker frame.

4. The combination according to claim 1 wherein the ram means second location has four means defining passages radiating outwardly to the exterior surface of the ram means.

5. The combination according to claim 1 wherein the air delivery housing includes means in communication with a source of pressurized air.

6. The combination according to claim 5 wherein the pressurized air source provides between about 30 to 60 psi.

7. In a can body maker having a ram with a first end for further forming a can body shell and a second end, said first end including means for delivering a fluid flow to effect at least in part the separation of a further formed can body shell from the ram, switch means for initiating and terminating the fluid flow, said switch means comprising a modified ram means having an exterior surface and a generally, axially disposed passage extending from the first end of the ram means to a second location distal said first end, said second location having means defining at least one passage radiating outwardly from the axially disposed passage to the ram means exterior surface; an air delivery housing defining therein a bore adapted to receive therein the ram means, said housing further defining a cavity in fluid communication with said bore, wherein during a first predetermined portion of the reciprocal motion of the ram means, the at least one passage radiating outwardly to the exterior surface of the ram means is in fluid communication with the air delivery housing bore initiating fluid flow thereinbetween while during a further portion of the reciprocal motion of the ram means, the surface of the ram means terminates fluid flow from the air delivery housing to the axially disposed passage of the ram means.

8. The switch means according to claim 7 wherein the air delivery housing includes an upper half and a lower half.

9. The switch means according to claim 7 wherein the air delivery housing includes mounting means adapted to support the air delivery housing in the can body maker frame.

10. The switch means according to claim 7 wherein the ram means second location has four means defining passages radiating outwardly to the exterior surface of the ram means.

11. The switch means according to claim 7 wherein the housing includes means in communication with a source of pressurized air.

12. The switch means according to claim 11 wherein the pressurized air source provides between about 30 to 60 psi.

13. In combination with a can body maker including a frame adapted to support therein a ram means having an exterior surface and a generally, axially disposed passage extending from a first location proximate a first end of the ram means to a second location distal said first end and mounted for reciprocal motion within the can body maker frame and a tool pack housing adapted to cooperate with the ram means for the drawing and ironing of a can shell to form a can body, an improved air delivery system for effecting the removal of a formed can body from the ram, said air delivery system comprising, an air delivery housing mounted in the can body maker frame and defining therein a bore adapted to receive therein the ram means, said housing further defining a cavity in fluid communication with said bore, and wherein the ram means said second location includes means defining at least one passage radiating outwardly from the axially disposed passage to the ram means exterior surface; wherein during a first predetermined portion of the reciprocal motion of the ram means, the at least one passage radiating outwardly to the exterior surface of the ram means is in fluid communication with the air delivery housing bore to permit fluid flow thereinbetween.

14. The combination according to claim 13 wherein the surface of the ram means inhibits fluid flow from the air delivery housing to the axially disposed passage of the ram means such that in at least a second predetermined portion of the reciprocal motion of the ram means air flow to the ram axially disposed passage is inhibited.

15. The combination according to claim 13 wherein the air delivery housing includes an upper half and a lower half.

16. The combination according to claim 13 wherein the air delivery housing includes mounting means adapted to support the air delivery housing in the can body maker frame.

17. The combination according to claim 13 wherein the ram means second location has four means defining passages radiating outwardly to the exterior surface of the ram means.

18. The combination according to claim 13 wherein the housing includes means in communication with a source of pressurized air.

19. The combination according to claim 18 wherein the pressurized air source provides between about 30 to 60 psi.

20. A pressurized air delivery system adapted for use in a can body maker comprising:

a ram means for the forming of a can body, said ram means having an exterior surface and a generally, axially disposed passage extending from a first location proximate a first end of the ram means to a second location distal said first end, said second location having means defining at least one passage radiating outwardly from the axially disposed passage to the ram means exterior surface; and an air delivery housing defining therein a bore adapted to receive therein the ram means, said housing further defining a cavity in fluid communication with said bore, wherein during a first predetermined position of the ram means with respect to the air delivery housing, the at least one passage radiating outwardly to the exterior surface of the ram means is in fluid communication with the air delivery housing bore to permit fluid flow thereinbetween while during a further position of the ram means with respect to the air delivery housing, the surface of the ram means inhibits fluid flow from the air delivery housing to the axially disposed passage of the ram means.

21. The pressurized air delivery system according to claim 20 wherein the air delivery housing includes an upper half and a lower half.

22. The pressurized air delivery system according to claim 20 wherein the air delivery housing includes mounting means adapted to support the air delivery housing in the can body maker.

23. The pressurized air delivery system according to claim 20 wherein the ram means second location has four means defining passages radiating outwardly to the exterior surface of the ram means.

24. The pressurized air delivery system according to claim 20 wherein the housing includes means in communication with a source of pressurized air.

25. The pressurized air delivery system according to claim 24 wherein the pressurized air source provides between about 30 to 60 psi.

26. A method of initiating and terminating the flow of pressurized air to an air stripper in a can body maker comprising the steps of:

providing a ram means for the forming of a can body, said ram means having an exterior surface and a generally, axially disposed passage extending from a first location proximate a first end of the ram means to a second location distal said first end, said second location having means defining at least one passage radiating outwardly from the axially disposed passage to the ram means exterior surface; and providing an air delivery housing defining therein a bore adapted to receive therein the ram means, said housing further defining a cavity in fluid communication with said bore, reciprocating said ram means between a first position and a second position wherein during the first position of the ram means with respect to the air delivery housing, the at least one passage radiating outwardly to the exterior surface of the ram means is in fluid communication with the air delivery housing bore to initiate fluid flow thereinbetween while during the second position of the ram means with respect to the air delivery housing, the surface of the ram means terminates fluid flow from the air delivery housing to the axially disposed passage of the ram means.

* * * * *